US008997519B2

(12) United States Patent
Briend

(10) Patent No.: US 8,997,519 B2
(45) Date of Patent: Apr. 7, 2015

(54) METHOD AND DEVICE FOR THE CRYOGENIC SEPARATION OF A METHANE-RICH FLOW

(75) Inventor: Pierre Briend, Seyssinet (FR)

(73) Assignee: L'Air Liquide, Societe Anonyme pour l'Etude et l'Exploitation des Procedes Georges Claude, Paris (FR)

( * ) Notice: Subject to any disclaimer, the term of this patent is extended or adjusted under 35 U.S.C. 154(b) by 1083 days.

(21) Appl. No.: 12/602,734

(22) PCT Filed: Jun. 6, 2008

(86) PCT No.: PCT/FR2008/051017

§ 371 (c)(1),
(2), (4) Date: Dec. 2, 2009

(87) PCT Pub. No.: WO2009/004207

PCT Pub. Date: Jan. 8, 2009

(65) Prior Publication Data

US 2010/0192627 A1 Aug. 5, 2010

(30) Foreign Application Priority Data

Jun. 14, 2007 (FR) ..... 07 55758

(51) Int. Cl.
*F25J 3/00* (2006.01)
*F25J 3/02* (2006.01)

(52) U.S. Cl.
CPC ..... *F25J 3/0209* (2013.01); *F25J 3/0233* (2013.01); *F25J 3/0257* (2013.01); *F25J 2200/02* (2013.01); *F25J 2200/74* (2013.01); *F25J 2210/40* (2013.01); *F25J 2210/42* (2013.01); *F25J 2210/66* (2013.01); *F25J 2215/04* (2013.01); *F25J 2215/40* (2013.01); *F25J 2220/66* (2013.01); *F25J 2270/12* (2013.01); *F25J 2270/14* (2013.01); *F25J 2270/42* (2013.01); *F25J 2270/904* (2013.01); *F25J 2270/908* (2013.01); *F25J 2280/02* (2013.01); *F25J 2205/66* (2013.01); *F25J 2270/16* (2013.01); *F25J 2270/30* (2013.01)

(58) Field of Classification Search
CPC ..... F25J 3/0209; F25J 3/0233; F25J 3/0257; F25J 3/0214; F25J 3/0266; F25J 2220/66; F25J 2220/42; F25J 2270/42; B01D 53/0462–53/0476
USPC ..... 62/619, 620, 927, 611
See application file for complete search history.

(56) References Cited

U.S. PATENT DOCUMENTS 3,989,478 A 11/1976 Jones
4,185,978 A * 1/1980 McGalliard et al. ..... 62/634

(Continued)

FOREIGN PATENT DOCUMENTS

| | | | |
|---|---|---|---|
| CN | 1908559 | A | 2/2007 |
| DE | 951875 | C | 11/1956 |
| DE | 4425712 | A1 | 1/1996 |
| FR | 1410494 | A | 9/1965 |
| JP | 4225778 | B2 | 2/2009 |

OTHER PUBLICATIONS

PCT/FR2008/051017; International Search Report and Written Opinion; Mar. 11, 2013.

*Primary Examiner* — Frantz Jules
*Assistant Examiner* — Brian King
(74) *Attorney, Agent, or Firm* — Justin K. Murray

(57) ABSTRACT

A method and device for the cryogenic separation of a methane-rich flow is provided.

25 Claims, 6 Drawing Sheets

(56) References Cited

U.S. PATENT DOCUMENTS 4,229,195 A * 10/1980 Forg ..... 62/612
4,285,709 A 8/1981 Gram
5,220,797 A * 6/1993 Krishnamurthy et al. ..... 62/620
5,486,227 A * 1/1996 Kumar et al. ..... 95/41
6,205,813 B1 * 3/2001 Shah et al. ..... 62/630
7,231,784 B2 * 6/2007 Howard et al. ..... 62/613
2003/0029191 A1 * 2/2003 Oakey ..... 62/620
2005/0061029 A1 * 3/2005 Narinsky ..... 62/620

* cited by examiner

METHOD AND DEVICE FOR THE CRYOGENIC SEPARATION OF A METHANE-RICH FLOW

This application is a §371 of International PCT Application PCT/FR2008/051017, filed Jun. 6, 2008.

FIELD OF THE INVENTION

The present invention relates to a method and device for the cryogenic separation of a methane-rich flow.

BACKGROUND

In order to purify a methane-rich flow coming from an organic source, so as to produce a purified product, it is necessary to remove impurities such as carbon dioxide, oxygen and nitrogen. Ideally, the product contains less than 2% carbon dioxide and less than 2% for the total content of oxygen and nitrogen.

All composition percentages in this document are molar percentages.

SUMMARY OF THE INVENTION

According to one object of the invention, a method is provided for the cryogenic separation of a methane-rich feed flow also containing carbon dioxide and either nitrogen or oxygen or both these, in which:

i) the flow is sent to an adsorption purification unit for producing a flow lean in carbon dioxide relative to the feed flow
ii) at least part of the carbon dioxide-lean flow is cooled so as to produce a cooled flow
iii) at least part of the cooled flow is sent to the distillation column
iv) a flow rich in methane relative to the feed flow is withdrawn from the distillation column
v) a flow rich in nitrogen and/or oxygen relative to the feed flow is withdrawn from the distillation column
vi) characterized in that the purification unit is regenerated by at least part of the vaporized methane-rich liquid.

According to other optional features:

vaporized methane that has served as a regenerating gas constitutes a product and preferably contains between 1 and 3% carbon dioxide;
the carbon dioxide-lean flow is cooled upstream of the column by means of at least one fluid withdrawn from the column;
the fluid withdrawn from the column is the nitrogen-rich and/or oxygen-rich flow;
the fluid withdrawn from the column is the methane-rich flow;
the methane-rich flow is withdrawn in liquid form;
the methane-rich liquid vaporizes by heat exchange with the carbon dioxide-lean flow;
the carbon dioxide content of the vaporized liquid that has served for regeneration is kept substantially constant, in particular by mixing therewith part of the vaporized methane-rich liquid taken upstream of the purification unit;
cooling is at least partially maintained by vaporizing a liquid nitrogen flow coming from an external source;
liquid nitrogen vaporizes by heat exchange with the carbon dioxide-lean flow;
liquid nitrogen vaporizes in a condenser at the top of the column;

cooling is at least partially maintained by a refrigerating cycle;
the methane-rich flow is produced in gaseous and/or liquid form;
a reboiler at the bottom of the column is heated, possibly with at least part of the flow to be separated;
the methane-rich flow withdrawn from the column contains at least 98 or even 99% methane;
the feed flow contains between 75 and 95% methane;
the feed flow contains between 3 and 25% in total of nitrogen and/or oxygen.

According to another feature of the invention, an apparatus is provided for the cryogenic separation of a methane-rich feed flow also containing carbon dioxide and either nitrogen or oxygen or both, comprising:

i) an adsorption purification unit and means for sending the feed flow there in order to produce a flow lean in carbon dioxide relative to the feed flow
ii) means for cooling at least part of the carbon dioxide-lean flow to produce a cooled flow
iii) a distillation column and means for sending at least part of the cooled flow to the distillation column
iv) means for withdrawing a flow rich in methane relative to the feed flow from the distillation column, and
v) means for withdrawing a flow rich in nitrogen and/or oxygen relative to the feed flow from the distillation column.

DETAILED DESCRIPTION OF THE INVENTION

Figure 1:
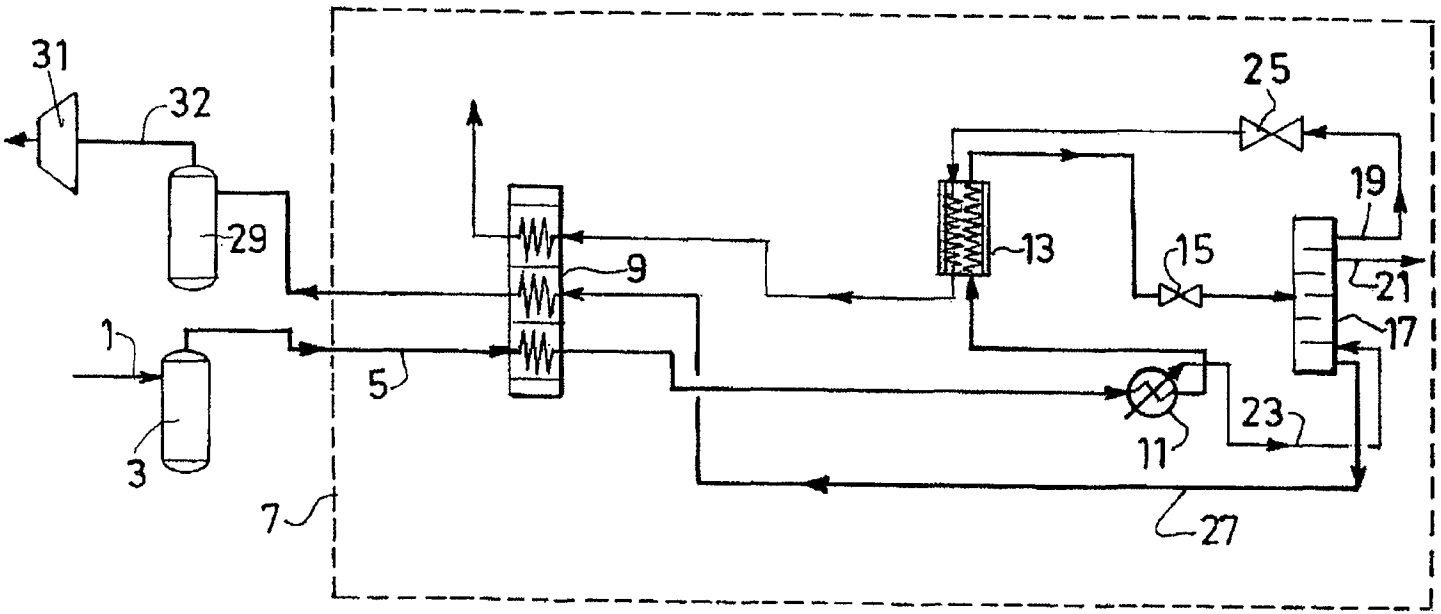
FIG. 1 illustrates schematically an apparatus according to one embodiment of the present invention.

For a further understanding of the nature and objects for the present invention, reference should be made to the detailed description, taken in conjunction with the accompanying drawing, in which like elements are given the same or analogous reference numbers and wherein:

In FIG. 1, a feed gas 1 at average temperature and average pressure (5 to 15 bar) having been purified in a permeation and/or adsorption unit, contains >75% methane, <2% carbon dioxide and <25% in total of oxygen and nitrogen. Of these 25%, approximately 20% consists of nitrogen and the rest oxygen. The oxygen and nitrogen contents widely exceed that desired for the product.

Figure 2:
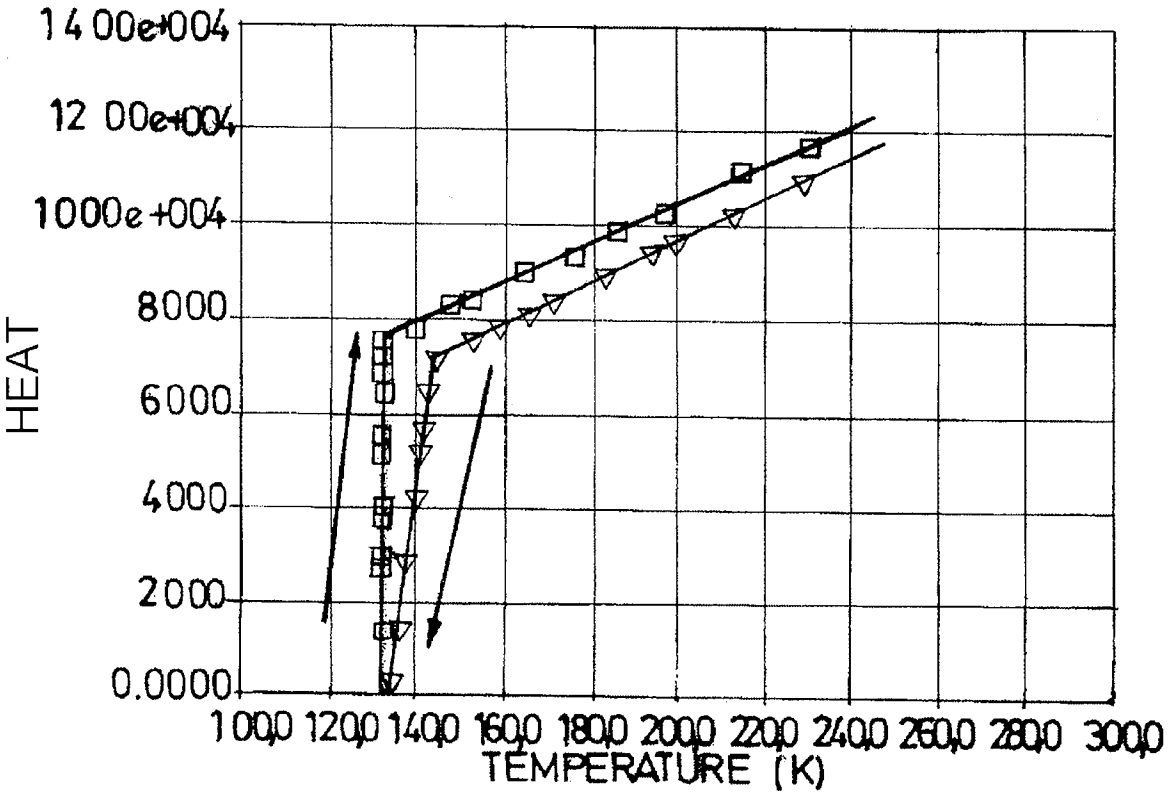
FIG. 2 illustrates a graph representing heat exchange taking place in an exchanger of the apparatus according to one embodiment of the present invention.

The gas 1 is sent to an adsorption unit consisting of two bottles of adsorbent 3, 29 to produce a $CO_2$-lean flow 5. This flow 5 is sent to a cold box 7 containing heat exchangers 9, 13 and a column 17. The flow 5, containing between 75 and 95% methane and 3 to 25% in total of nitrogen and oxygen, is cooled and partially liquefies in the heat exchanger 9, according to the graph that may be seen in FIG. 2.

The exchanger 9 is an exchanger with brazed aluminum or stainless steel plates.

The cooled flow 15, which is two-phase, ensures reboiling from a bottom reboiler 11 of the column 17 and the heat produced 23 is transferred to the bottom of the column. The flow 5 is then liquefied in the heat exchanger 13, is expanded to half its pressure in a valve 15 and sent to an intermediate point of the column 17.

In this column 17, which contains structured packings, distillation of the liquefied flow 5 is carried out so as to produce a methane-rich liquid flow 27 at the bottom containing less than 2% in total of nitrogen and oxygen and a gaseous flow 19 at the top of the column enriched in nitrogen and/or oxygen and containing less than 5% methane.

The top condenser 67 (FIGS. 3 and 4) of the column 17 is cooled in various ways, in order to remove heat 21 from the column.

For example, the condenser 67 may be cooled by trickling in liquid nitrogen coming from an external source.

Cold may also be provided by a machine for producing cooling, such a Stirling motor, a Gifford MacMahon machine, a pulse tube etc.

Figure 3:
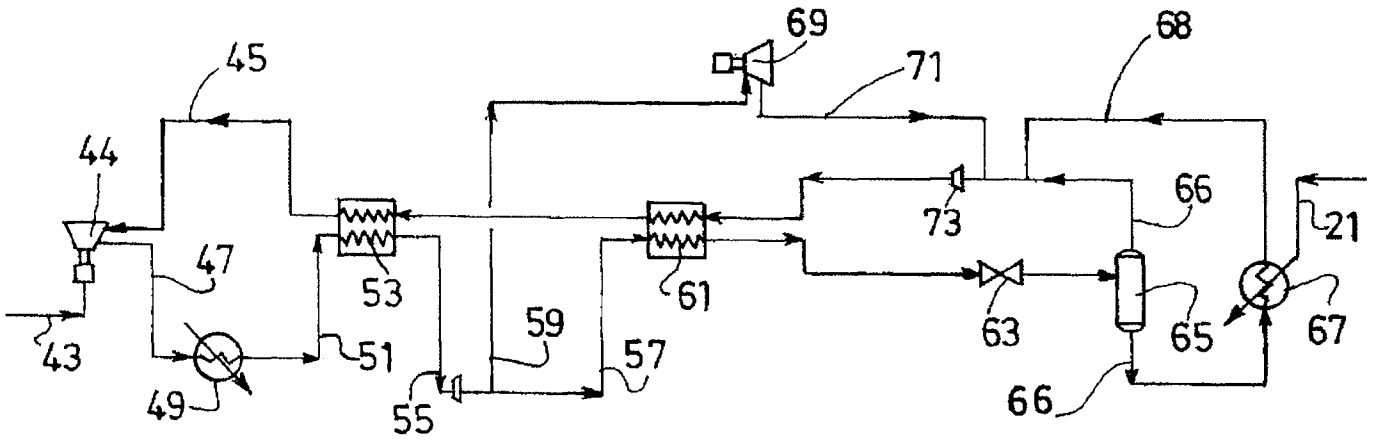
FIG. 3 illustrates cycles for the production of negative kilocalories that may be used for the production of cold necessary for the method according to one embodiment of the present invention.
Figure 4:
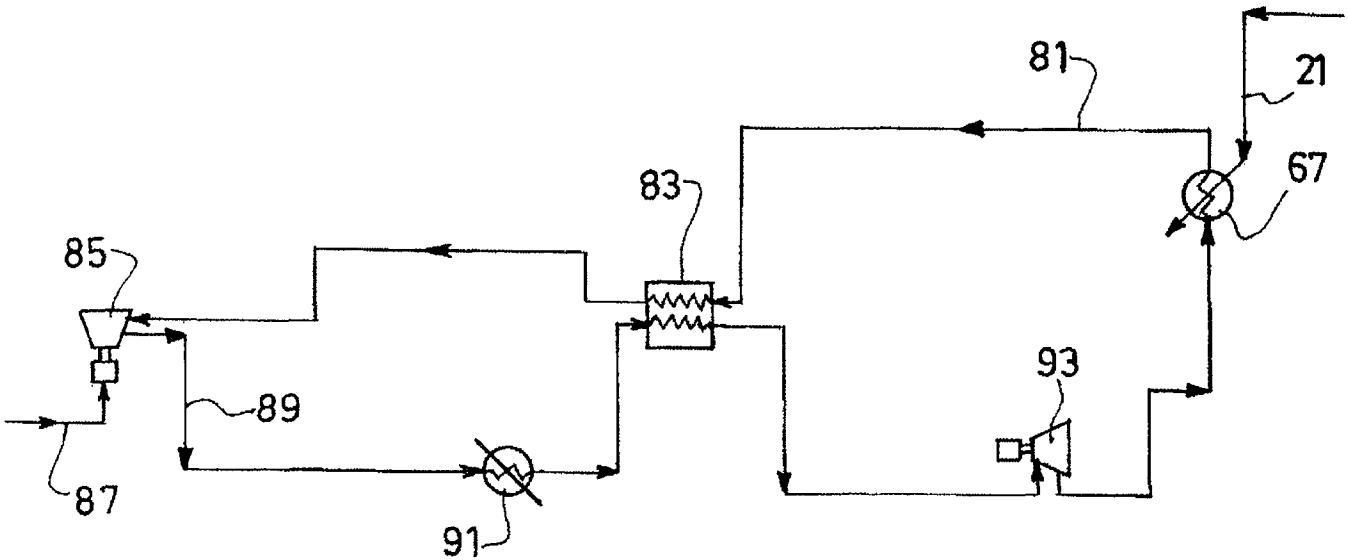
FIG. 4 illustrates cycles for the production of negative kilocalories that may be used for the production of cold necessary for the method according to one embodiment of the present invention.

Alternatively, negative kilocalories for the condenser 67 may be provided by a nitrogen cycle, as illustrated in FIG. 3. Nitrogen 66 is sent to the condenser 67 where it evaporates to form the gas 67. The gas 67 is mixed with the gas 66 from the top of the phase-separator 65 and then with the flow 71. The flow 45 formed in this way is sent to a mixer, cooled in the exchangers 61, 53 and then compressed in the compressor 44 supplied with power 43. The compressed flow 47 is cooled in an exchanger 49 to form the flow 51, heated in the exchanger 53 to form the gas 55 and expanded in a turbine 55. The flow 55 is divided in two, one part 59 being sent to the turbine 69 to form the flow 71, the rest 57 being sent to the exchanger 61. The flow 57 expands in the valve 63 and is sent to the phase separator 65. The liquid flow from the separator 65 is sent to the condenser 67.

Another possibility (FIG. 4) is to use a Brayton cycle with helium as the cycle fluid. A gas 81, heated in the condenser 67 is sent to an exchanger 83, compressed in a compressor 85 and supplied with power 87 to form the flow 89. This flow is sent to the exchanger 91 and then to the exchanger 83. It is then expanded in a turbine 93 before being sent to the condenser 67.

In the case where methane is produced solely in gaseous form, liquid methane 27 containing <2% nitrogen+oxygen and >98% methane, vaporizes by heat exchange in the exchanger 9.

The residue enriched in nitrogen and/or oxygen 19 reheats the mixture to be separated in the exchanger 13, is reheated in the exchanger 9 and is sent to air. It contains less than 5% methane.

Figure 5:
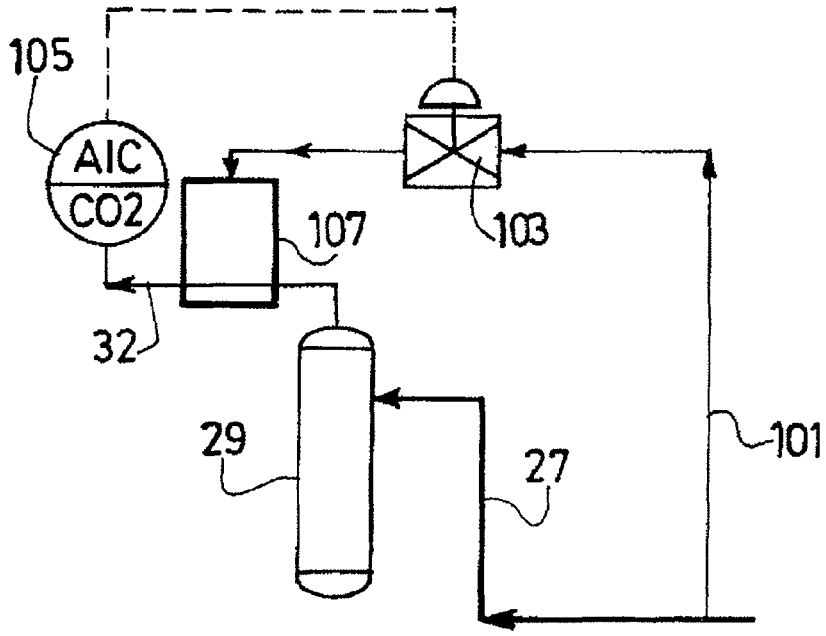
FIG. 5 illustrates represents schematically one feature of an apparatus according to one embodiment of the present invention.

As shown in detail in FIG. 5, methane vaporized in the exchanger 9 is sent to the other bottle of adsorbents 29 so as to regenerate it and the regenerating gas 32 produced in this way serves as a process product, being carbon dioxide-rich relative to the flow 27 to contain between 1 and 3 mol % carbon dioxide, for example.

The carbon dioxide content of the product 32 is analyzed by an AIC analyzer 105 and the content is kept substantially constant by means of a valve 103 controlled by the AIC which opens a bypass duct 101 enabling the gas 102 that is richer in methane to be mixed with the flow 32 according to requirements. As the absorbers are operated cyclically, this arrangement is necessary in order to prevent a cyclic variation in purity of the product 32.

Optionally, the product 32 is compressed in one or more compressors 31 to a high pressure (20 to 30 bar) and even to a very high pressure (200 to 350 bar) as illustrated in FIG. 1.

This product contains a little more than >96% methane, <2% nitrogen+oxygen and <2% $CO_2$.

Figure 6:
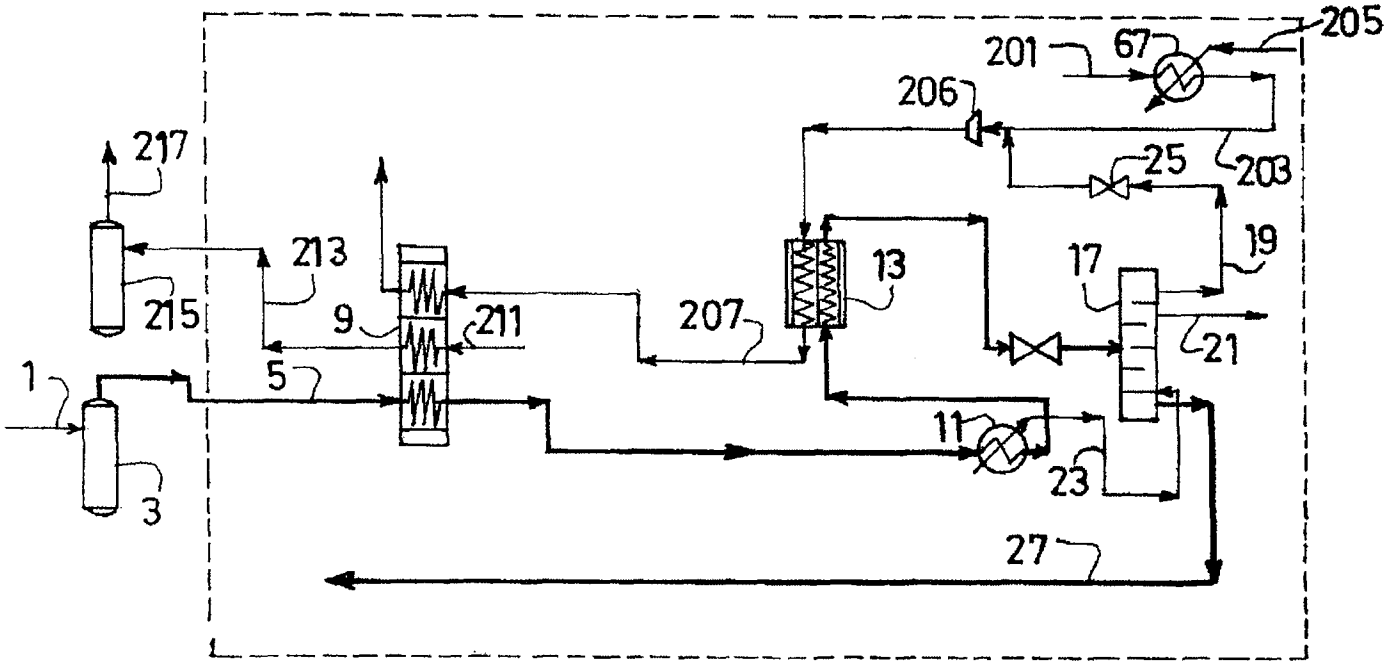
FIG. 6 illustrates represent schematically an apparatus according to one embodiment of the present invention.

A method according to the invention is illustrated in FIG. 6 that enables methane to be produced in liquid form. A feed gas 1, having been purified in a permeation unit, contains 76.5% methane, 1.6% carbon dioxide and 22% in total of oxygen and nitrogen. The oxygen and nitrogen contents widely exceed that desired for the product.

The gas 1 is sent to the adsorption unit consisting of two bottles of adsorbent 3, 29 so a to produce a flow 5 lean in $CO_2$. This flow 5 is sent to a cold box 7 containing heat exchangers 9, 13 and a column 17. The flow 5 containing between 75 and 95% methane and 3 to 25% in total of nitrogen and oxygen, is cooled and partially liquefied in the heat exchanger 9, according to the graph that may be seen in FIG. 2.

The cooled flow 5, which is two-phase, ensures reboiling from a bottom reboiler 11 of the column 17 and the heat produced 23 is transferred to the bottom of the column. The flow 5 is then liquefied in the heat exchanger 13, is expanded in the valve 15 and sent to an intermediate point of the column 17.

The liquefied flow 5 is distilled in this column 17, which contains structured packings, so as to produce a methane-rich liquid flow 27 at the bottom containing less than 2% in total of nitrogen+oxygen and a gaseous flow 19 at the top of the column enriched in nitrogen+oxygen and containing less than 5% methane.

The top condenser 203 (FIGS. 3 and 4) of the column 17 is cooled by trickling in liquid nitrogen 201 coming from an external source.

The residue enriched in nitrogen and/or oxygen 19 is expanded in a valve 25, mixed with the vaporized liquid nitrogen 204 that is trickled in. The mixed flow 207 is mixed in a mixer, cools the mixture to be separated in the exchanger 13, is reheated in the exchanger 9 and is sent to air. It contains less than 5% methane.

Liquid methane 27 is produced as the final product.

In order to keep the exchanger 9 cold, another trickle flow of nitrogen 211 is sent to the exchanger 9 where it vaporizes to form the flow 213. This nitrogen flow 213 then serves to regenerate the bottle of adsorbents 215 before being discharged to atmosphere as the flow 217.

Alternatively, as in FIG. 1, nitrogen 211 may be replaced by part of the product 27.

It will be understood that any cold source indicated in FIG. 1 may be used for the method of FIG. 6.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. A method for the cryogenic separation of a methane-rich feed flow also comprising carbon dioxide and a second impurity selected from the group consisting of nitrogen, oxygen, and a combination thereof, said method comprising the steps of:

i) sending the methane-rich feed flow to an adsorption purification unit to produce a carbon dioxide-lean flow having less carbon dioxide relative to the methane-rich feed flow;

ii) cooling at least part of the carbon dioxide-lean flow to produce a cooled flow;

iii) sending at least part of the cooled flow to a distillation column;

iv) withdrawing a methane-rich product flow from the distillation column, the methane-rich product flow being richer in methane relative to the methane-rich feed flow;

v) withdrawing a flow rich in the second impurity from the distillation column, the flow rich in the second impurity being richer in the second impurity relative to the methane-rich feed flow, vi) vaporizing at least part of the methane-rich product flow;

vii) regenerating the adsorption purification unit using a regeneration fluid comprising at least part of the vaporized methane-rich product flow, such that a second product stream comp sing methane and carbon dioxide is produced;

viii) monitoring the carbon dioxide content of the second product stream; and ix) maintaining the carbon dioxide content of the second product stream within a given threshold.

2. The method of claim 1, wherein the carbon dioxide-lean flow is cooled upstream of the column by means of at least one fluid withdrawn from the column.

3. The method of claim 2, wherein the fluid withdrawn from the column is the flow rich in nitrogen and/or oxygen.

4. The method of claim 2, wherein the fluid withdrawn from the column is the methane-rich product flow.

5. method of claim 4, wherein the methane-rich product flow is withdrawn in liquid form.

6. The method of claim 5, wherein the methane-rich product flow is vaporized by heat exchange with the carbon dioxide-lean flow.

7. The method of claim 1, wherein the carbon dioxide content of the second product is kept substantially constant.

8. The method of claim 7, wherein the carbon dioxide content of the second product is kept substantially constant by mixing therewith part of the vaporized methane-rich product flow taken upstream of the adsorption purification unit.

9. The method of claim 1, wherein cooling is at least partially maintained by vaporizing a liquid nitrogen flow coming from an external source.

10. The method of claim 9, wherein liquid nitrogen vaporizes by heat exchange with the carbon dioxide-lean flow.

11. The method of claim 9, further comprising a condenser at the top of the distillation column, and wherein liquid nitrogen vaporizes in said condenser.

12. The method of claim 1, wherein cooling is at least partially maintained by a refrigerating cycle.

13. The method of claim 1, wherein the methane-rich product flow is produced in gaseous form.

14. The method of claim 1, wherein the methane-rich product flow is produced in liquid form.

15. The method of claim 1, further comprising a reboiler at the bottom of the distillation column, wherein the reboiler is heated.

16. The method of claim 15, wherein the reboiler is heated with at least part of the flow to be separated.

17. The method of claim 1, wherein the methane-rich product flow withdrawn from the distillation column contains at least 98% methane.

18. The method of claim 1, wherein the methane-rich product flow withdrawn from the distillation column contains at least 99% methane.

19. The method of claim 1, wherein the methane-rich feed flow contains between 75% and 95% methane.

20. The method of claim 1, wherein the methane-rich feed flow contains between 3% and 25% in total of nitrogen and/or oxygen.

21. The method of claim 1, wherein step ix) further comprises adding a methane rich fluid to the second product stream.

22. The method of claim 21, wherein the methane rich fluid comprises the methane-rich product flow.

23. The method of claim 21, wherein the methane rich fluid comprises the methane-rich product flow vaporized from step vi).

24. The method of claim 1, wherein step ix) further comprises the steps of mixing a portion of the methane-rich product flow with the second product stream without passing the portion of the methane-rich product flow through the adsorption purification unit.

25. The method of claim 1, wherein the second product stream has an increased amount of carbon dioxide as compared to the vaporized methane-rich product flow.

* * * * *